US009295129B1

(12) United States Patent
Xiao et al.

(10) Patent No.: US 9,295,129 B1
(45) Date of Patent: Mar. 22, 2016

(54) TURN ON OPTIMIZATION

(71) Applicants: Peng Xiao, Andover, MA (US); Keng Chen, Sudbury, MA (US); Andrew Johnsen, Danvers, MA (US)

(72) Inventors: Peng Xiao, Andover, MA (US); Keng Chen, Sudbury, MA (US); Andrew Johnsen, Danvers, MA (US)

(73) Assignee: OSRAM SYLVANIA INC., Wilmington, MA (US)

( * ) Notice: Subject to any disclaimer, the term of this patent is extended or adjusted under 35 U.S.C. 154(b) by 0 days.

(21) Appl. No.: 14/677,884

(22) Filed: Apr. 2, 2015

(51) Int. Cl.
*H05B 33/08* (2006.01)

(52) U.S. Cl.
CPC ..... *H05B 33/089* (2013.01); *H05B 33/0809* (2013.01); *H05B 33/0848* (2013.01)

(58) Field of Classification Search
CPC .. H05B 33/08; H05B 33/089; H05B 33/0809; H05B 33/0851; H05B 33/0842; H05B 33/0848
USPC ..... 315/185 R, 291, 297, 307, 308
See application file for complete search history.

(56) References Cited

U.S. PATENT DOCUMENTS

2010/0238724 A1* 9/2010 Fukuda ..... G11C 16/349 345/185.03
2014/0101135 A1* 4/2014 Yousaf ..... G06F 17/30442 707/722

* cited by examiner

*Primary Examiner* — Thai Pham
(74) *Attorney, Agent, or Firm* — Shaun P. Montana

(57) ABSTRACT

Systems, methods, and computer program products for turn on optimization of a driver for one or more light sources are disclosed. A duty cycle value is selected from a table. The selected duty cycle corresponds to the target output current of the driver and has a corresponding voltage. The selected duty cycle is applied to the driver. An output voltage at the light source is measured, and compared to the corresponding voltage of the selected duty cycle to produce a voltage comparison result. Based on the comparison result, the selection of the duty cycle is adjusted. Additionally, an output current of the light source is measured and compared to the target output current, to produce a current comparison result. An adjustment coefficient is applied to a feedback circuit of the driver based thereon, wherein the feedback circuit adjusts a switching frequency of the driver based on the selected duty cycle.

20 Claims, 12 Drawing Sheets

TURN ON OPTIMIZATION

TECHNICAL FIELD

The present invention relates to electronics, and more specifically, to optimizing the turn on time for drivers for solid state light sources.

BACKGROUND

The continued development of high-brightness solid state light sources for use in general illumination applications has led to increased use of such light sources in various general illumination lighting devices. In general, a solid state light source operates in a fundamentally different way than a conventional filament or gas lamp, and typically operates off of direct current (DC) power, as opposed to alternating current (AC) power, which is found throughout buildings. A driver is used to allow lighting devices including solid state light sources to run off of AC power by converting an AC input, such as a 120V/60 Hz line input, to a stable direct current (DC) voltage, which is used to drive the solid state light source(s). Such a circuit typically incorporates an electromagnetic interference (EMI) filter, a power factor correction circuit, and a rectifier, arranged in a particular topology. A variety of topologies for drivers are well-known in the art. One example is an LCC topology, including an inductor and two capacitors in a tank circuit configuration, which can provide a constant current output.

SUMMARY

A conventional LCC topology for a constant current driver requires a slow loop response for good control of the current provided to the solid state light source being driven. However, such a topology prevents a fast turn on time for the driver, which can lead to the overshooting or undershooting the desired output current. Overshooting or undershooting the desired output current can lead to lack of stability and flashing the solid state light sources, which are undesirable outcomes. The alternative to an LCC topology is to use a buck converter to deliver a constant current output, but this increases complexity and cost.

Embodiments of the present invention provide a turn on optimization of an LCC topology for a constant current driver. The turn on optimization leads to a stable output current being reached in a short amount of time (e.g., less than one second), which prevents flashing of the solid state light sources being driven by the driver. Embodiments use a pre-determined table of duty cycle values, stored within the driver, for a variety of possible output currents and corresponding output voltages. Depending on the desired output current, a series of selected duty cycle values are chosen from the table and applied to a feedback circuit of the driver. The feedback circuit adjusts a switching frequency of the LCC tank circuit, resulting in the output current reaching a stable state without causing flashing of the solid state light sources.

In an embodiment, there is provided a method of optimizing driver turn on to prevent flashing of a light source powered by the driver. The method includes selecting, from a table of duty cycle values, a highest duty cycle value corresponding to a target output current of the driver, wherein the selected duty cycle value has a corresponding voltage; applying the selected duty cycle value to the driver; measuring an output voltage at the light source connected to an output of the driver; comparing the measured output voltage to the corresponding voltage of the selected duty cycle to produce a voltage comparison result; and adjusting the selection of the duty cycle based on the voltage comparison result.

In another related embodiment, the method may further include measuring an output current at the light source connected to the output of the driver; comparing the measured output current to the target output current to produce a current comparison result; and applying an adjustment coefficient to a feedback circuit of the driver, wherein the feedback circuit adjusts a switching frequency of the driver based on the selected duty cycle. In a further related embodiment, comparing the measured output current may include comparing the measured output current to the target output current to produce a current comparison result, wherein the current comparison result indicates that the measured output current is within a threshold range of the target output current; and applying may include applying a mild adjustment coefficient to a feedback circuit of the driver, wherein the feedback circuit adjusts a switching frequency of the driver based on the selected duty cycle and the applied mild adjustment coefficient.

In another further related embodiment, comparing the measured output current may include comparing the measured output current to the target output current to produce a current comparison result, wherein the current comparison result indicates that the measured output current exceeds a threshold range of the target output current; and applying may include applying an aggressive adjustment coefficient to a feedback circuit of the driver, wherein the feedback circuit adjusts a switching frequency of the driver based on the selected duty cycle and the applied aggressive adjustment coefficient.

In yet another related embodiment, the method may further include repeating measuring, comparing, and adjusting until a most recent voltage comparison result indicates that a desired voltage comparison result is reached. In still another related embodiment, the method may further include prior to selecting, querying a microcontroller to learn a target output current of the driver, wherein the target output current of the driver is a preset value.

In yet still another related embodiment, the method may further include prior to selecting, querying a microcontroller to learn a target output current of the driver, if the driver is to dim the light source, and a preset output current of the driver; and selecting may include calculating a voltage range based on the preset output current of the driver and a power range of the driver, wherein the voltage range includes a high voltage value and a low voltage value; and selecting, from a table of duty cycle values, a duty cycle value corresponding to the target output current of the driver and the low voltage value of the calculated voltage range, wherein the low voltage value of the calculated voltage range is the corresponding voltage. In a further related embodiment, the method may further include: measuring an output current at the light source connected to the output of the driver; comparing the measured output current to the target output current to produce a current comparison result; and applying an adjustment coefficient to a feedback circuit of the driver, wherein the feedback circuit adjusts a switching frequency of the driver based on the selected duty cycle. In a further related embodiment, comparing the measured output current may include comparing the measured output current to the target output current to produce a current comparison result, wherein the current comparison result indicates that the measured output current is within a threshold range of the target output current; and applying may include applying a mild adjustment coefficient to a feedback circuit of the driver, wherein the feedback circuit adjusts a switching frequency of the driver based on the selected duty cycle and the applied mild adjustment coefficient. In another further related embodiment, comparing the measured output current may include comparing the measured output current to the target output current to produce a current comparison result, wherein the current comparison result indicates that the measured output current exceeds a threshold range of the target output current; and applying may include applying an aggressive adjustment coefficient to a feedback circuit of the driver, wherein the feedback circuit adjusts a switching frequency of the driver based on the selected duty cycle and the applied aggressive adjustment coefficient.

In another embodiment, there is provided a computer program product, stored on a non-transitory computer readable medium, including instructions that, when executed on a processor in communication with a driver to power a light source, cause the processor to perform operations of: selecting, from a table of duty cycle values, a highest duty cycle value corresponding to a target output current of the driver, wherein the selected duty cycle value has a corresponding voltage; applying the selected duty cycle value to the driver; measuring an output voltage at the light source connected to an output of the driver; comparing the measured output voltage to the corresponding voltage of the selected duty cycle to produce a voltage comparison result; and adjusting the selection of the duty cycle based on the voltage comparison result.

In a related embodiment, the instructions may cause the processor to perform further operations of measuring an output current at the light source connected to the output of the driver; comparing the measured output current to the target output current to produce a current comparison result; and applying an adjustment coefficient to a feedback circuit of the driver, wherein the feedback circuit adjusts a switching frequency of the driver based on the selected duty cycle. In another related embodiment, the instructions may cause the processor to perform further operations of repeating measuring, comparing, and adjusting until a most recent voltage comparison result indicates that a desired voltage comparison result is reached. In still another related embodiment, the instructions may cause the processor to perform further operations of prior to selecting, querying a microcontroller to learn a target output current of the driver, wherein the target output current of the driver is a preset value. In yet another related embodiment, the instructions may cause the processor to perform further operations of prior to selecting, querying a microcontroller to learn a target output current of the driver, if the driver is to dim the light source, and a preset output current of the driver; and the processor may perform operations of selecting by calculating a voltage range based on the preset output current of the driver and a power range of the driver, wherein the voltage range includes a high voltage value and a low voltage value; and selecting, from a table of duty cycle values, a duty cycle value corresponding to the target output current of the driver and the low voltage value of the calculated voltage range, wherein the low voltage value of the calculated voltage range is the corresponding voltage.

In another embodiment, there is provided a system to prevent flashing of a light source. The system includes: a driver to power the light source, and a computer system. The computer system includes a processor; a memory; an input interface and an output interface, each in communication with the driver; and an interconnection mechanism allowing communication between the processor, the memory, the input interface, and the output interface. The memory includes a turn on optimization application that, when executed in the processor as a turn on optimization process, causes the computer system to perform operations of: selecting, from a table of duty cycle values stored in the memory, a highest duty cycle value corresponding to a target output current of the driver, wherein the selected duty cycle value has a corresponding voltage; applying, via the output interface, the selected duty cycle value to the driver; measuring, via the input interface, an output voltage at the light source connected to an output of the driver; comparing the measured output voltage to the corresponding voltage of the selected duty cycle to produce a voltage comparison result; and adjusting the selection of the duty cycle based on the voltage comparison result.

In a related embodiment, the driver may include a feedback circuit, and the computer system may perform further operations of: measuring, via the input interface, an output current at the light source connected to the output of the driver; comparing the measured output current to the target output current to produce a current comparison result; and applying, via the output interface, an adjustment coefficient to the feedback circuit of the driver, wherein the feedback circuit adjusts a switching frequency of the driver based on the selected duty cycle.

In another related embodiment, the computer system may perform further operations of repeating measuring, comparing, and adjusting until a most recent voltage comparison result indicates that a desired voltage comparison result is reached. In yet another related embodiment, the computer system may perform further operations of prior to selecting, querying the memory to learn a target output current of the driver, wherein the target output current of the driver is a preset value. In still another related embodiment, the computer system may perform further operations of prior to selecting, querying the memory to learn a target output current of the driver, if the driver is to dim the light source, and a preset output current of the driver; and when selecting, the computer system may perform operations of: calculating a voltage range based on the preset output current of the driver and a power range of the driver, wherein the voltage range includes a high voltage value and a low voltage value; and selecting, from a table of duty cycle values stored in the memory, a duty cycle value corresponding to the target output current of the driver and the low voltage value of the calculated voltage range, wherein the low voltage value of the calculated voltage range is the corresponding voltage.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
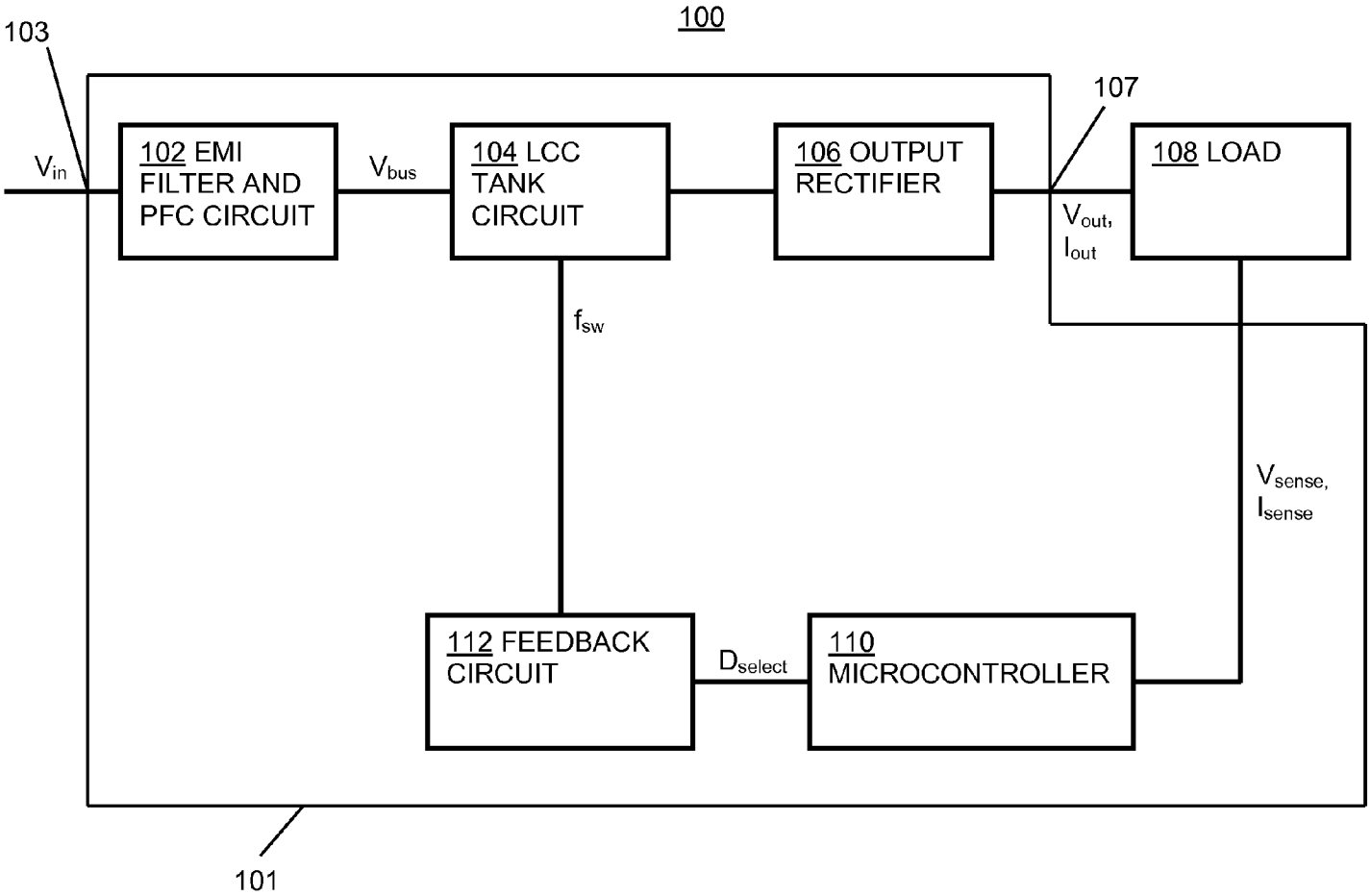
FIG. 1 shows a block diagram of a system according to embodiments disclosed herein.

FIG. 1 shows a block diagram of a system 100. The system 100 includes a driver 101 and a load 108. The driver 101 receives an input voltage $V_{in}$ at an input 103 and provides an output voltage $V_{out}$ and an output current $I_{out}$ at an output 107 of the driver to the load 108. For convenience of explanation, the load 108 is described throughout as being a light source 108, such as but not limited to one or more solid state light sources, such as X. However, any load 108 that is to receive a constant output current $I_{out}$ from the driver 101 is within the scope of the invention.

The input voltage $V_{in}$ is provided to an EMI filter and PFC circuit 102, which filters out undesirable electromagnetic interface and provide power factor control, resulting in a bus voltage $V_{bus}$. The bus voltage $V_{bus}$ is provided to an LCC tank circuit 104. The LCC tank circuit 104 provides a voltage and current to an output rectifier 106 that is based on a switching frequency $f_{sw}$ of the LCC tank circuit 104. In some embodiments, as described below, the switching frequency $f_{sw}$ of the LCC tank circuit 104 is set by a feedback circuit 112. The output rectifier 106 provides the output voltage $V_{out}$ and the output current $I_{out}$ at an output 107 of the driver to the light source 108. A microcontroller 110 senses the output voltage $V_{out}$ as a sensed voltage $V_{sense}$ and the output current $I_{out}$ as a sensed current $I_{sense}$ from the light source 108. Using one or both of these values, the microcontroller 110 provides a selected duty cycle value $D_{select}$ to the feedback circuit 112. Based on the selected duty cycle value $D_{select}$, the feedback circuit 112 adjusts the switching frequency $f_{sw}$ of the LCC tank circuit 104, as is described in greater detail below.

Figure 2:
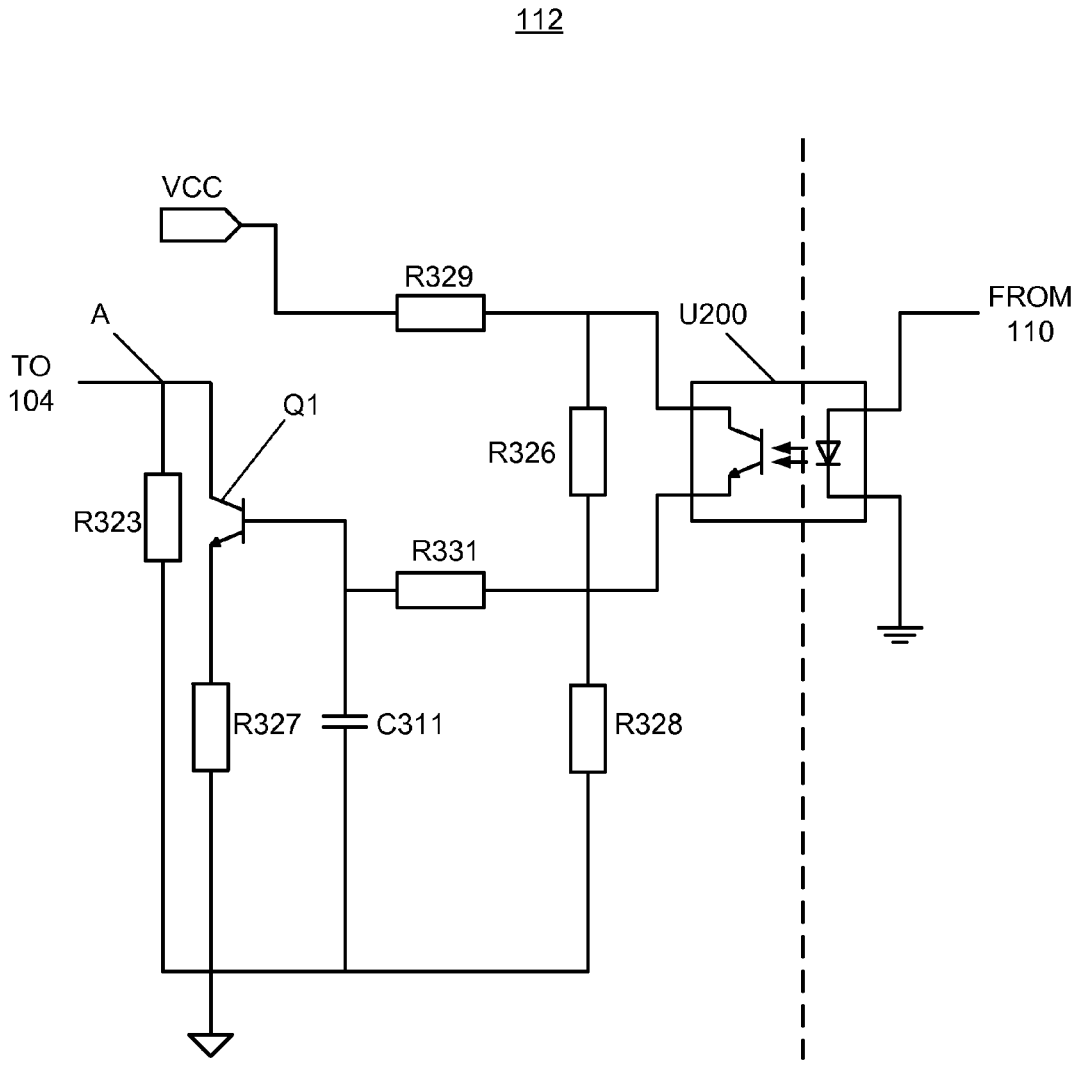
FIG. 2 illustrates a circuit diagram of a feedback circuit according to embodiments disclosed herein.

FIG. 2 is a circuit diagram of the feedback circuit 112. The feedback circuit receives a selected duty cycle value $D_{select}$ (shown in FIG. 1) from the microcontroller 110. In some embodiments, the selected duty cycle value $D_{select}$ is sent as a pulse width modulated (PWM) signal from the microcontroller 110 to the feedback circuit 112. The selected duty cycle value $D_{select}$ passes through an optocoupler U200, which provides isolation within the driver 101. An output side of the optocoupler U200 is in parallel with a first resistor R326. A second resistor R329 is connected between VCC and the parallel combination of the optocoupler U200 and the first resistor R326. A third resistor R328 is in parallel with a series combination of a fourth resistor R331 and a capacitor C311 between ground and the parallel combination of the optocoupler U200 and the first resistor R326. A transistor Q1, having a base, a collector, and an emitter, is connected to a fifth resistor R323 and a sixth resistor R327. More specifically, the base of the transistor Q1 is connected between the fourth resistor R331 and the capacitor C311. The sixth resistor R327 is connected between the emitter of the transistor Q1 and ground. The fifth resistor R323 is connected in parallel across the collector and the emitter of the transistor Q1. A point A between the fifth resistor R323 and the collector of the transistor Q1 is connected to the LCC tank circuit 104 (shown in FIG. 1) and provides the switching frequency $f_{sw}$ for the LCC tank circuit 104. More specifically, the switching frequency $f_{sw}$ output by the feedback circuit 112 has a linear relationship with the resistance of the feedback circuit 112 between the point A and ground. The fifth resistor R323 sets up the minimum switching frequency that could be provided to the LCC tank circuit 104, and the sixth resistor R327 along with the transistor Q1 and the other components of the feedback circuit 112 tune the switching frequency $f_{sw}$ output by the feedback circuit 112 to the LCC tank circuit 104.

Figure 3:
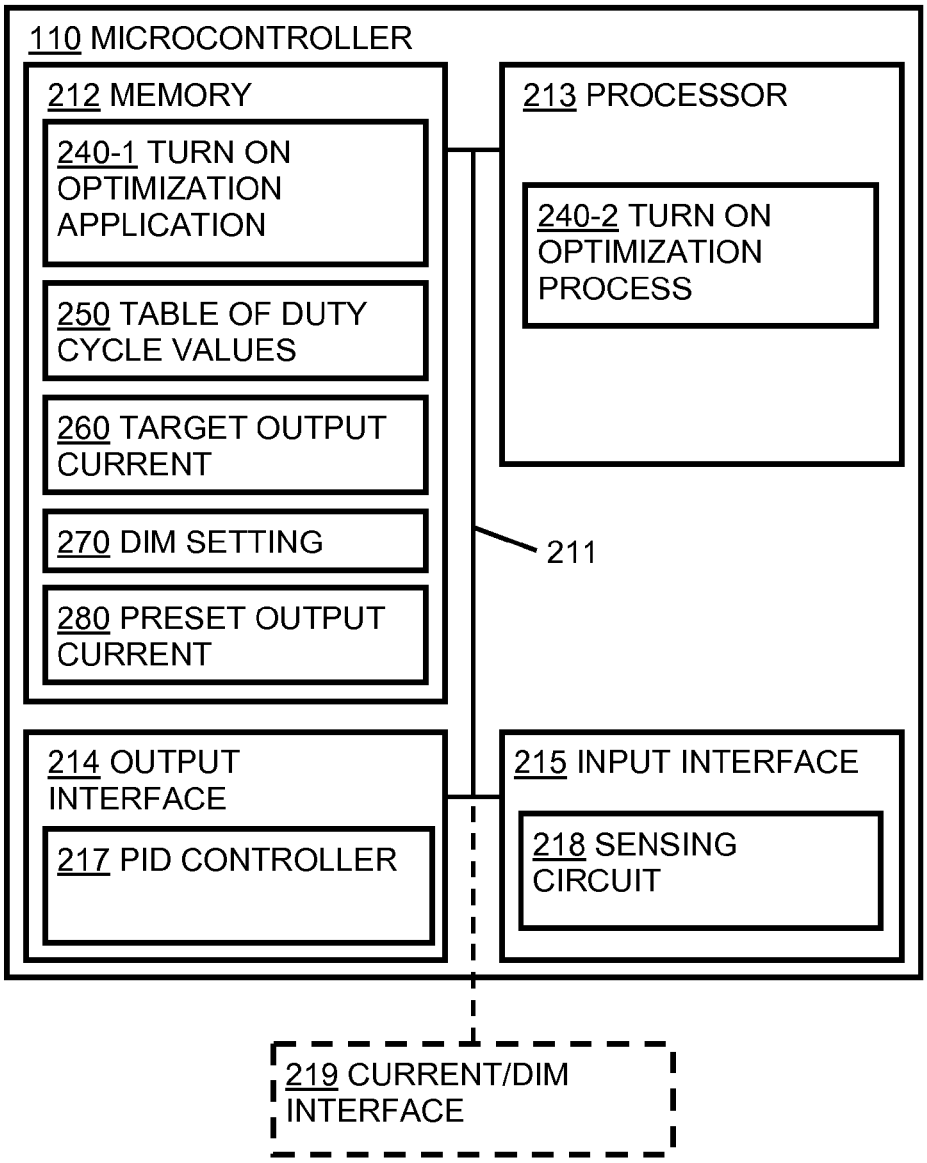
FIG. 3 shows a block diagram of a microcontroller according to embodiments disclosed herein.

FIG. 3 shows a block diagram of an example architecture of the microcontroller 110, which includes a memory 212, a processor 213, an output interface 214, an input interface 215, and an interconnection mechanism 211, such as a data bus or other circuitry, that couples the memory 212, the processor 213, the output interface 214, and the input interface 215. In some embodiments, the microcontroller 110 is optionally connected to an optional current/dim interface 219 via an optional connection of the interconnection mechanism 211, as shown in FIG. 3. Though FIG. 3 shows the optional current/dim interface 219 as being separate from the microcontroller 110, in some embodiments, the optional current/dim interface 219 is integrated within the microcontroller 110, and in some embodiments the optional current/dim interface 219 is not integrated within the microcontroller 110 but is integrated within the driver 101, either as a standalone circuit or as part of another circuit within the driver 101. Alternatively, in some embodiments, the optional current/dim interface 219 is separate from the driver 101 but connected thereto. The optional current/dim interface 219 may be, and in some embodiments is, a mechanical device such as but not limited to a switch or selector wheel, is a user input interface, a set of wires, a control device, and/or any other known interface for providing current values and dimming settings to the driver 101.

The microcontroller 110 is shown and referred to as a microcontroller for convenience, and embodiments are not so limited. That is, any type of computer system or computerized device (such as but not limited to a processor, microprocessor, controller, etc.) that includes a memory, a processor, input and output interfaces, and an interconnection mechanism, that is able to execute, run, interpret, operate or otherwise perform as described herein is a suitable alternative for the microcontroller 110. Further, though FIG. 1 shows the microcontroller 110 as being part of the driver 101, embodiments are not so limited, such that the microcontroller 110 or equivalent computer system may be physically separate from, yet in communication with, the driver 101, without departing from the scope of the invention.

The memory system 212 is any type of computer readable medium and in some embodiments is encoded with a turn on optimization application 240-1 that includes a turn on optimization process 240-2. The turn on optimization application 240-1 may be, and in some embodiments is, embodied as software code such as data and/or logic instructions (e.g., code stored in the memory 212 or on another computer readable medium such as a removable drive) that supports processing functionality according to different embodiments described herein. During operation of the microcontroller 110, the processor 213 accesses the memory 212 via the interconnection mechanism 211 in order to launch, run, execute, interpret or otherwise perform the logic instructions of the turn on optimization application 240-1. Execution of the turn on optimization application 240-1 in this manner produces processing functionality in a turn on optimization process 240-2. In other words, the turn on optimization process 240-2 represents one or more portions or runtime instances of the turn on optimization application 240-1 performing or executing within or upon the processor 213 in the microcontroller 110 at runtime.

It is noted that example configurations disclosed herein include the turn on optimization application 240-1 itself including the turn on optimization process 240-2 (i.e., in the form of un-executed or non-performing logic instructions and/or data). The turn on optimization application 240-1 may be, and in some embodiments is, stored on a computer readable medium (such as a disk, disk drive, electronic, magnetic, optical, solid state, or other computer readable medium). The turn on optimization application 240-1 may also be, and in some embodiments is, stored in the memory 212 as firmware in, for example, read only memory (ROM), or as executable code in, for example, Random Access Memory (RAM). In addition to these embodiments, it should also be noted that other embodiments herein include the execution of the turn on optimization application 240-1 in the processor 213 as the turn on optimization process 240-2. Those skilled in the art will understand that the microcontroller 110 may, and in some embodiments does, include other processes and/or software and hardware components, such as but not limited to an operating system, not shown in this example.

In addition to storing the turn on optimization application 240-1, the memory 212, in some embodiments, also stores information used by the turn on optimization application 240-1 when executing in the processor 213 as the turn on optimization process 240-2. This includes, but is not limited to, a table of duty cycle values 250, a target output current 260 of the driver 101, a dim setting 270 of the driver 101, and a preset output current 280.

The table of duty cycle values 250 includes one or more values representing a duty cycle for a particular output voltage and output current. The duty cycle values change both across output voltages and output currents. Thus, for example, there is an array of duty cycle values for an output current of 500 mA, with a different duty cycle value having a corresponding output voltage value. Similarly, there is an array of duty cycle values for an output voltage of 100 V, with a different duty cycle value having a corresponding output current value. In some embodiments, depending on the configuration of the driver 101, certain output voltage and output current pairs do not have a duty cycle value; in other words, in some embodiments, not every space in the table of duty cycle values 250 has a duty cycle value. The table of duty cycle values 250 is determined by, for example but not limited to, measuring the duty cycle of the driver 101 at steady state under various output voltage and output current load conditions, and recording the measured values accordingly in the table of duty cycle values 250. The table of duty cycle values 250 is then stored in the memory 212.

In some embodiments, the target output current 260 is a preset value that is loaded into the memory 212 during manufacture of the driver 101. In some embodiments, the target output current 260 is a preset value that is input to the driver 101 via, for example but not limited to, the optional current/dim interface 219, by for example, an end user (not shown) or a control device (not shown), and stored within the memory 212. In some embodiments, the target output current 260 is a variable value that is adjusted via, for example but not limited to, the optional current/dim interface 219, by, for example, an end user (not shown) or a control device (not shown), depending on operating conditions of the system 100, such as but not limited to the load 108 to be driven by the driver 101 or an ambient light sensor (not shown) in communication with the driver 101, and stored in the memory 212.

The dim setting 270 indicates whether the driver 101 will be dimming the light source 108 being driven by the driver 101. In some embodiments, the dim setting 270 is entered into the memory 212 via the optional current/dim interface 219. In some embodiments, the dim setting 270 includes a dimming curve that represents a change in the output current $I_{out}$ and/or the output voltage $V_{out}$ over a range of values as dimming occurs.

In some embodiments, the preset output current 280 is a preset value that is loaded into the memory 212 during manufacture of the driver 101. In some embodiments, the preset output current 280 is a preset value that is input to the driver 101 via, for example but not limited to, the optional current/dim interface 219, by for example but not limited to, an end user (not shown) or a control device (not shown), and stored within the memory 212. In some embodiments, the preset output current 280 is a variable value that is adjusted via, for example but not limited to, the optional current/dim interface 219, by, for example, an end user (not shown) or a control device (not shown), depending on operating conditions of the system 100, such as but not limited to the load 108 to be driven by the driver 101 or an ambient light sensor (not shown) in communication with the driver 101, and stored in the memory 212. In some embodiments, the target output current 260 is equivalent to the preset output current 280. In some embodiments, the target output current 260 is substantially equivalent to the preset output current 280.

The input interface 215 of the microcontroller 110, in some embodiments, receives the sensed voltage $V_{sense}$ and the sensed current $I_{sense}$ from the light source 108, and in some embodiments, the input interface 215 performs the sensing of the output voltage $V_{out}$ and the output current $I_{out}$ at the light source 108 via a sensing circuit 218. The sensing circuit 218 may be, and in some embodiments is, any known sensing circuit or device, such as but not limited to an operational amplifier. The input interface 215, in some embodiments, receives other signals from other components of the driver 101 (not shown). The output interface 214 of the microcontroller output the selected duty cycle value $D_{select}$ from the table of duty cycle values 250 stored in the memory 212. In some embodiments, the output interface 214 includes a PID controller 217, which applies an adjustment coefficient to the selected duty cycle value $D_{select}$, based on, for example but not limited to, an error calculation.

Flowcharts of embodiments of a method 400 are depicted in FIGS. 4-10B. The rectangular elements are herein denoted "processing blocks" and represent computer software instructions or groups of instructions. Alternatively, the processing blocks represent steps performed by functionally equivalent circuits such as a digital signal processor circuit or an application specific integrated circuit (ASIC). The flowcharts do not depict the syntax of any particular programming language. Rather, the flowcharts illustrate the functional information one of ordinary skill in the art requires to fabricate circuits and/or to generate firmware and/or computer software to perform the processing required in accordance with embodiments disclosed throughout. It should be noted that many routine program elements, such as initialization of loops and variables and the use of temporary variables, are not shown. It will be appreciated by those of ordinary skill in the art that unless otherwise indicated herein, the particular sequence of steps described is illustrative only and may be, and in some embodiments are, varied without departing from the spirit of the invention. Thus, unless otherwise stated, the steps described below are unordered meaning that, when possible, the steps may be, and in some embodiments are, performed in any convenient or desirable order.

Further, while FIGS. 4-10B illustrates various operations, it is to be understood that not all of the operations depicted in FIGS. 4-10B are necessary for other embodiments to function. Indeed, it is fully contemplated herein that in other embodiments of the present disclosure, the operations depicted in FIGS. 4-10B, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

Figure 4:
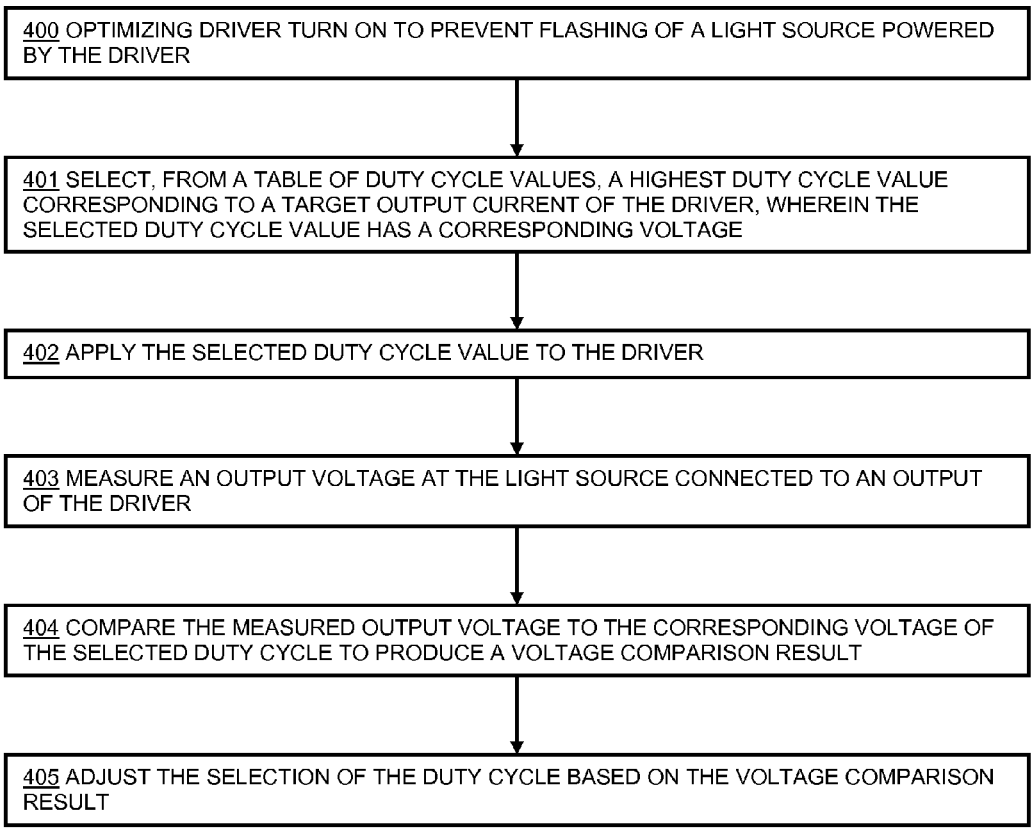
FIGS. 4-10B illustrate flowcharts of various procedures performed by the system of FIG. 1 when optimizing turn on of a driver according to embodiments disclosed herein.

FIGS. 4-10B each show embodiments of the turn on optimization application 240-1 executed as the turn on optimization process 240-2. FIG. 4, more specifically, shows a method 400 of optimizing driver turn on to prevent flashing of a light source powered by the driver, such as the light source 108 and the driver 101 shown in FIG. 1. The turn on optimization process 240-2 selects, from a table of duty cycle values, such as the table of duty cycle values 250 stored in the memory 212 shown in FIG. 3, a highest duty cycle value corresponding to a target output current, such as the target output current 260 or the preset output current 280, of the driver, such as the driver 101, step 401. The selected duty cycle value, such as $D_{select}$ shown in FIG. 1, has a corresponding voltage that is identified in the table of duty cycle values, such as the table of duty cycle values 250. The turn on optimization process 240-2 applies the selected duty cycle value $D_{select}$ to the driver 101, step 402, more specifically to the feedback circuit 112 of the driver circuit 101. This causes the switching frequency $f_{sw}$ of the LCC tank circuit 104 to be changed, which results in a corresponding change in the output voltage $V_{out}$ and the output current $I_{output}$ at the output 107 of the driver 101, thus resulting in the light source 108 receiving a changed output voltage $V_{out}$ and a changed output current $I_{out}$. The turn on optimization process 240-2 measures the changed output voltage $V_{out}$ at the light source 108 connected to the output 107 of the driver 101, step 403. The turn on optimization process 240-2 then compares the measured output voltage $V_{out}$ to the corresponding voltage of the selected duty cycle $D_{select}$ to produce a voltage comparison result, step 404. The voltage comparison result is the difference between the actual measured output voltage $V_{out}$ and the expected output voltage of the selected duty cycle $D_{select}$ as taken from the table of duty cycle values 250. Depending on the voltage comparison results, the turn on optimization process 240-2 adjusts the selection of the duty cycle based on the voltage comparison result, step 405. Thus, for example, if the measured output voltage $V_{out}$ is similar and/or substantially similar to the corresponding voltage of the selected duty cycle $D_{select}$ (for example, within a range of the corresponding voltage, such as but not limited to plus or minus 5 V, plus or minus 7.5 V, plus or minus 10 V, etc.), the turn on optimization process 240-2 does not adjust the selection of the duty cycle, but may, in some embodiments, apply an adjustment coefficient to the feedback circuit 112 via the selected duty cycle $D_{select}$, as described in greater detail below. As another example, if the measured output voltage $V_{out}$ is not similar and/or substantially similar to the corresponding voltage of the selected duty cycle $D_{select}$ (for example, within a range of the corresponding voltage, such as but not limited to plus or minus 5 V, plus or minus 7.5 V, plus or minus 10 V, etc.), the turn on optimization process 240-2 adjusts the selection of the duty cycle by, for example, choosing a selected duty cycle value that has a corresponding voltage that is similar and/or substantially similar to the measured output voltage $V_{out}$. The newly selected duty cycle $D_{select}$ (that is, the adjusted duty cycle value) is then provided to the feedback circuit 112, for example via the output interface 214 of the microcontroller 110. The turn on optimization process 240-2 determines the similarity of the measured output voltage $V_{out}$ to the corresponding voltage of the selected duty cycle $D_{select}$ according to any known criteria, not limited to the example criteria shown above.

Figure 5A:
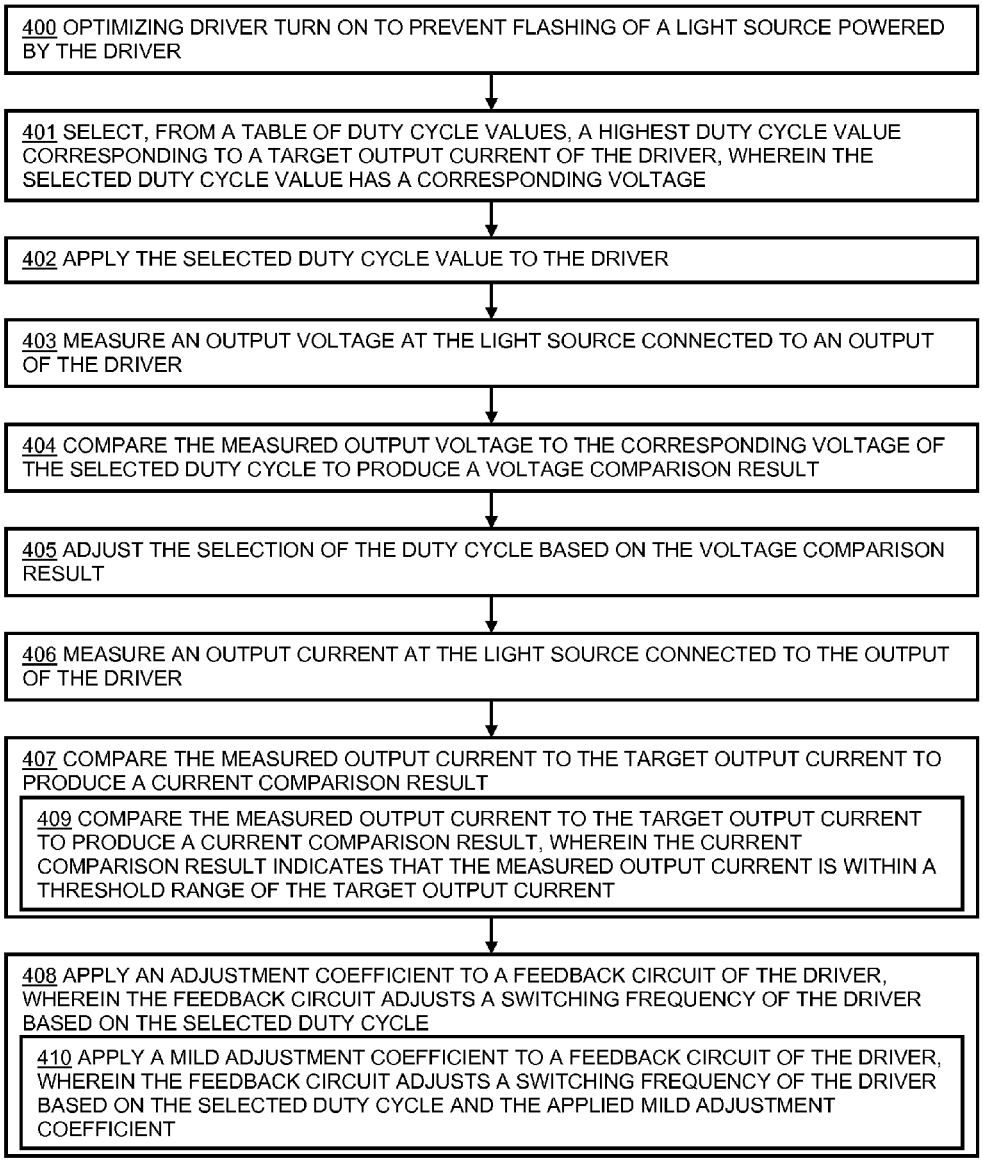

FIG. 5A describes an embodiment of the method 400 when an adjustment coefficient is applied to the selected duty cycle $D_{select}$, as initially described above. In FIG. 5A, the turn on optimization process 240-2 performs steps 401-405 as described above. The turn on optimization process 240-2 measures the output current $I_{out}$ at the light source 108 connected to the output 107 of the driver 101, step 406. The turn on optimization process 240-2 compares the measured output current $I_{out}$ to the target output current 260 (which may be, and in some embodiments is, the preset output current 280), stored in the memory 212, to produce a current comparison result, step 407. The turn on optimization process 240-2 applies an adjustment coefficient to the feedback circuit 112 of the driver 101, wherein the feedback circuit 112 adjusts the switching frequency $f_{sw}$ of the driver 101 (more specifically, the LCC tank circuit 104) based on the selected duty cycle $D_{select}$, step 408. In some embodiments, the PID controller 217 of the microcontroller 110 applies the adjustment coefficient. In some embodiments, the adjustment coefficient is based on an error calculation performed by the turn on optimization process 240-2 or another process or set of instructions within the microcontroller 110. The adjustment coefficient helps to bring the measured output current $I_{out}$ as close to the target output current 260 as possible. In some embodiments, the current comparison result indicates that the measured output current $I_{out}$ is within a threshold range of the target output current 260, step 409. This threshold range may be, and in some embodiments is, any range of current values that are similar and/or substantially similar to the target output current, such as but not limited to within plus or minus 3% of the target output current, plus or minus 8% of the target output current, plus or minus 12% of the target output current, and so on. Any desirable threshold range is possible. The turn on optimization process 240-2 then applies a mild adjustment coefficient to the feedback circuit 112 of the driver 101, wherein the feedback circuit 112 adjusts the switching frequency $f_{sw}$ of the driver 101 based on the selected duty cycle $D_{select}$ and the applied mild adjustment coefficient. The adjustment coefficient in such embodiments is mild because the measured output current $I_{out}$ is within the threshold range of the target output current 260, and thus, only a mild adjustment is needed to bring the measured output current $I_{out}$ as close to the target output current 260 as possible.

Figure 5B:
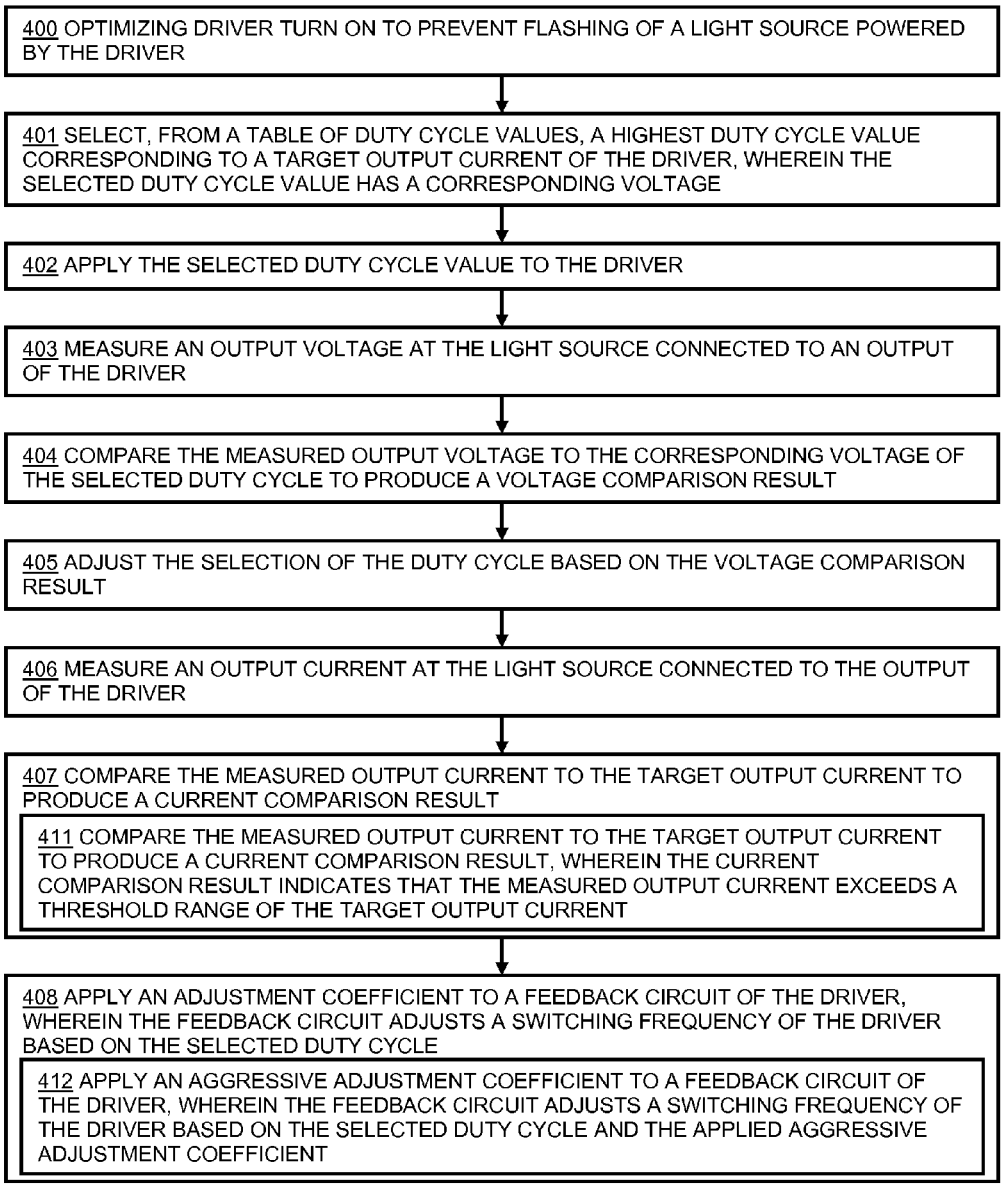

In some embodiments, such as shown in FIG. 5B, the turn on optimization process 240-2, when comparing the measured output current $I_{out}$ to the target output current 260 to produce a current comparison result, the current comparison result indicates that the measured output current $I_{out}$ exceeds a threshold range of the target output current 260, where the threshold range is as described above. In such embodiments, the turn on optimization process 240-2 applies an aggressive adjustment coefficient to the feedback circuit 112 of the driver 101, wherein the feedback circuit 112 adjusts the switching frequency $f_{sw}$ of the driver 101 based on the selected duty cycle $D_{select}$ and the applied aggressive adjustment coefficient. The adjustment coefficient in such embodiments is aggressive because the measured output current $I_{out}$ is outside the threshold range of the target output current 260, and thus, a more aggressive adjustment is needed to bring the measured output current $I_{out}$ as close to the target output current 260 as possible.

Figure 6:
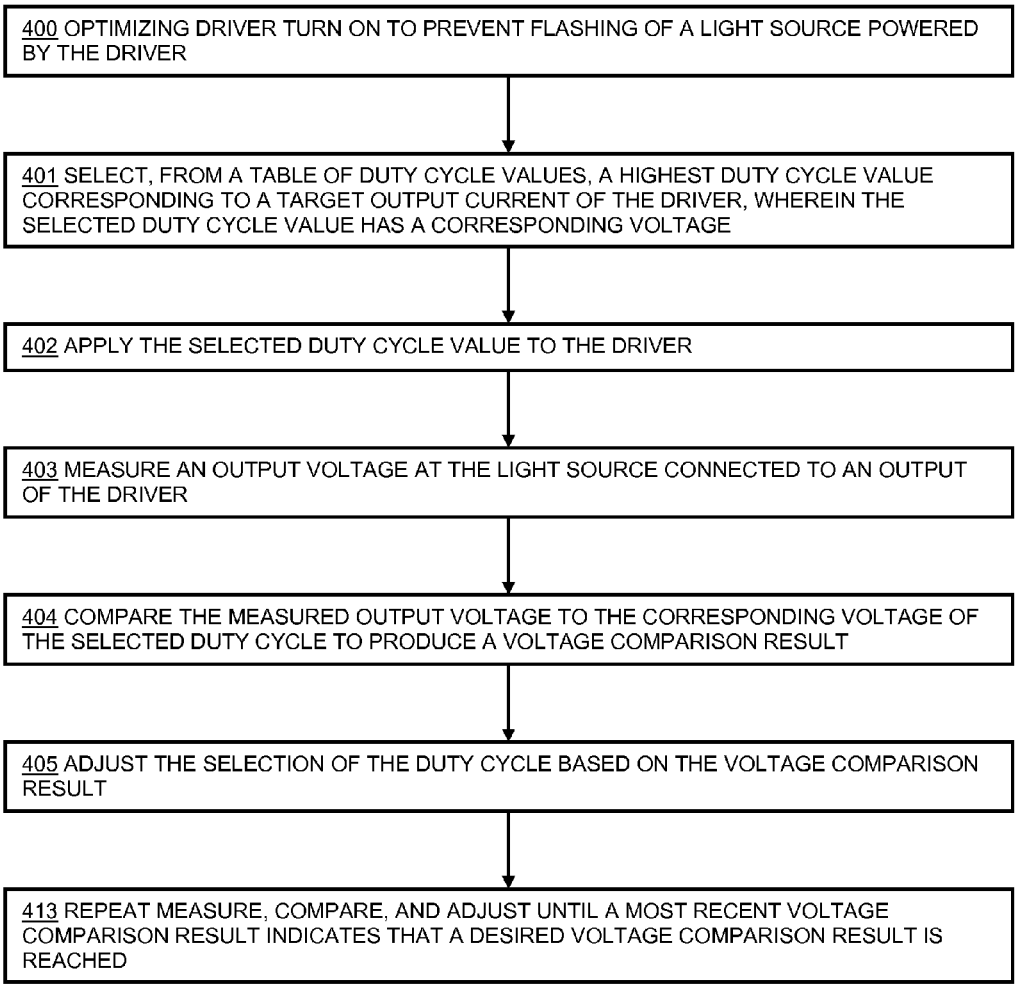

FIG. 6 shows the method 400 where the turn on optimization process 240-2 repeats, step 413, the steps of measuring, step 403, comparing, step 404, and adjusting, step 405, until a most recent voltage comparison result indicates that a desired voltage comparison result is reached. In some embodiments, the turn on optimization process 240-2 repeats these steps a defined number of times, such as but not limited to two time, three times, four times, five times, six times, and so on, that the most recent voltage comparison result indicates that a desired voltage comparison result has been reached if it is the second, third, fourth, fifth, sixth, etc., voltage comparison result produced the turn on optimization process 240-2. In some embodiments, the turn on optimization process 240-2 repeats these steps until the most recent voltage comparison result shows an insubstantial difference between the measured output voltage $V_{out}$ and the corresponding output voltage. In some embodiments, the turn on optimization process 240-2 waits a period of time in between repeating these steps, such as but not limited to 10 ms, 25 ms, 50 ms, 75 ms, 100 ms, and so on.

Figure 7:
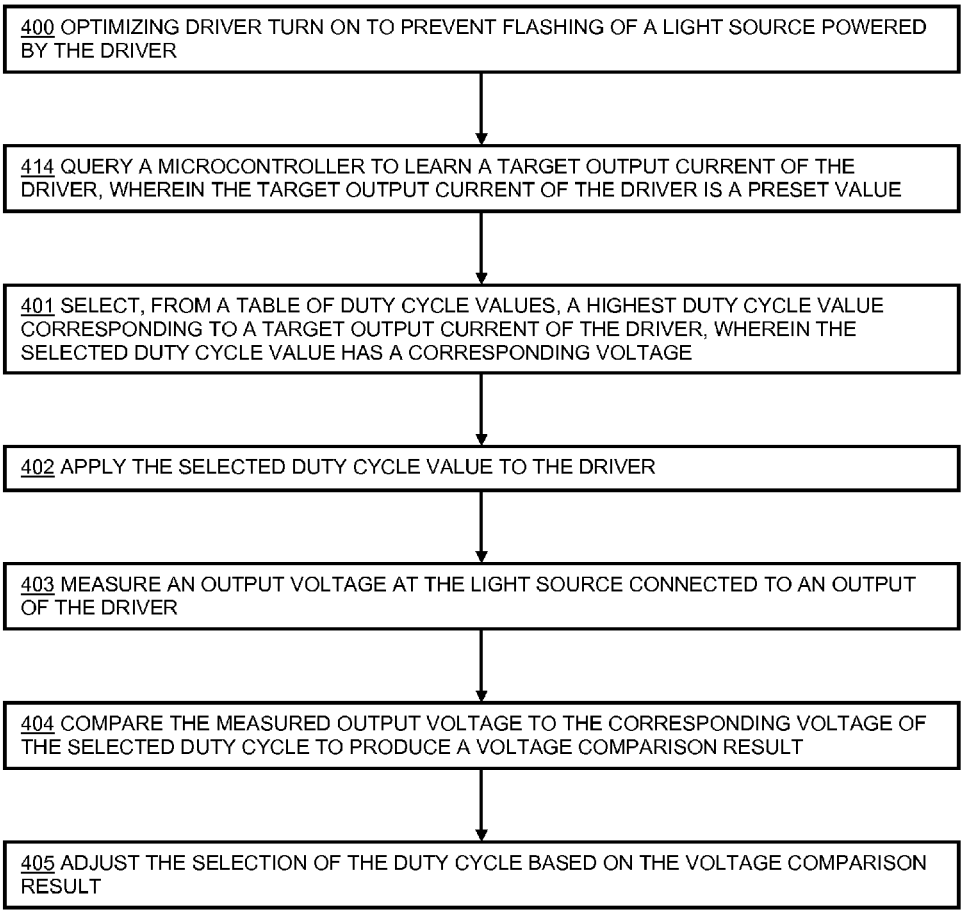

In some embodiments, such as shown in FIG. 7, the turn on optimization process 240-2 queries, step 414, the microcontroller 110 to learn the target output current 260 of the driver 101, prior to selecting the duty cycle value, step 401. In some embodiments, the target output current 260 of the driver 101 is a preset value. In some embodiments, the target output current 260 of the driver 101 is the preset output current 280.

Figure 8:
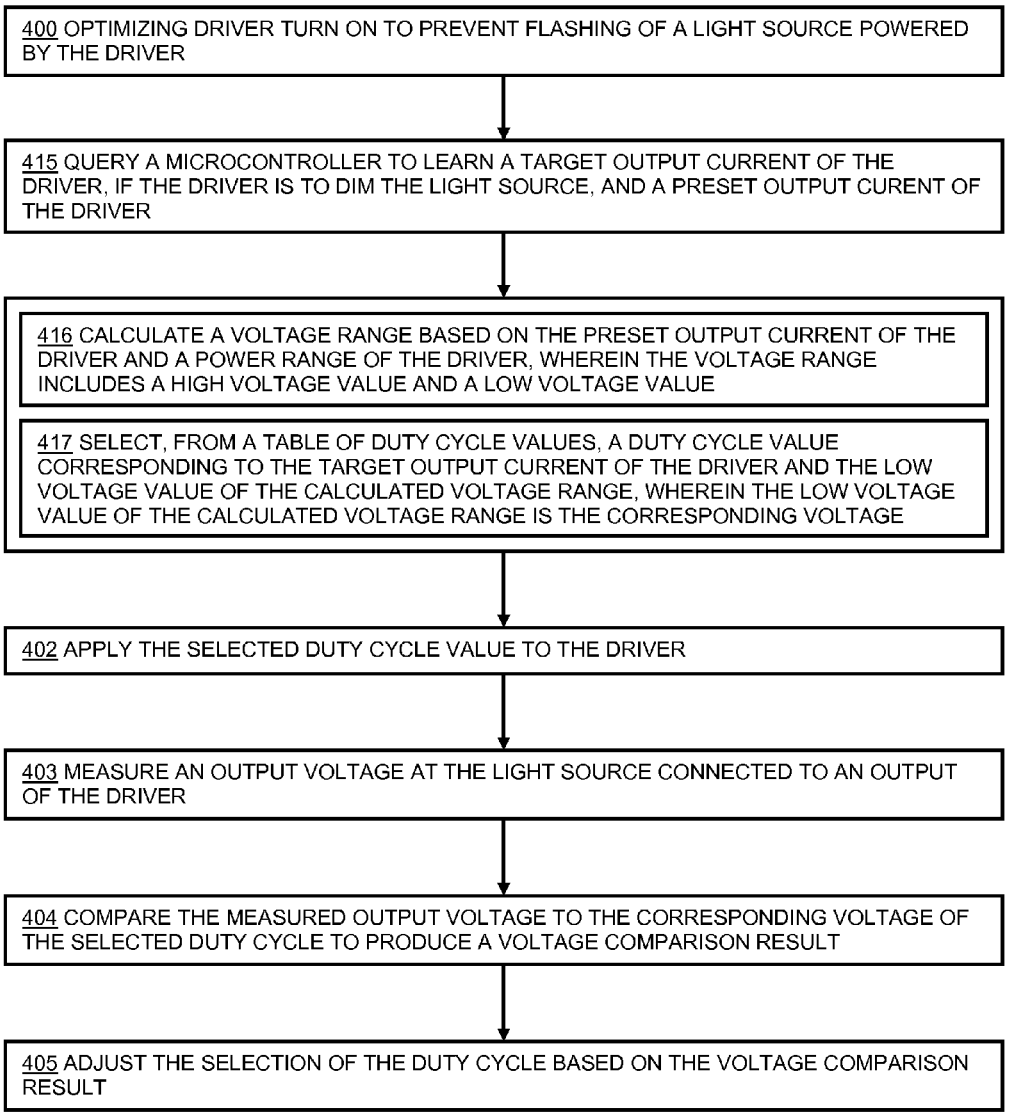

In some embodiments, such as shown in FIG. 8, the driver 101 is to dim the light source 108. In such embodiments, prior to selecting the duty cycle value, the turn on optimization process 240-2 queries the microcontroller 110 to learn the target output current 260 of the driver 101, as well as if the driver is to dim the light source 108, and the preset output current 280 of the driver 101, step 415. The turn on optimization process 240-2 learns that the driver 101 is to dim the light source 108 based on the dim setting 270. The turn on optimization process 240-2 then calculates a voltage range based on the preset output current 280 of the driver 101 and a power range of the driver 101, step 416. The power range of the driver 101 is the possible output power of the driver 101 from a minimum output power level (for example, 50 W) to a maximum output power level (100 W). The power range of the driver 101 is stored in the memory 212 of the microcontroller 110, for example but not limited to as part of the dim setting 270. The turn on optimization process 240-2 calculates the voltage range by dividing the minimum output power level of the driver 101 by the present output current 280 and by dividing the maximum output power level of the driver 101 by the present output current 280. The resulting voltage range dimming includes a high voltage value (i.e., the maximum output power level of the driver 101/the preset output current 280) and a low voltage value (i.e., the minimum output power level of the driver 101/the preset output current 280). The turn on optimization process 240-2 then selects, from the table of duty cycle values 250, a duty cycle value $D_{select}$ corresponding to the target output current 260 of the driver 101 and the low voltage value of the calculated voltage range, wherein the low voltage value of the calculated voltage range is the corresponding voltage, step 417.

Figure 9:
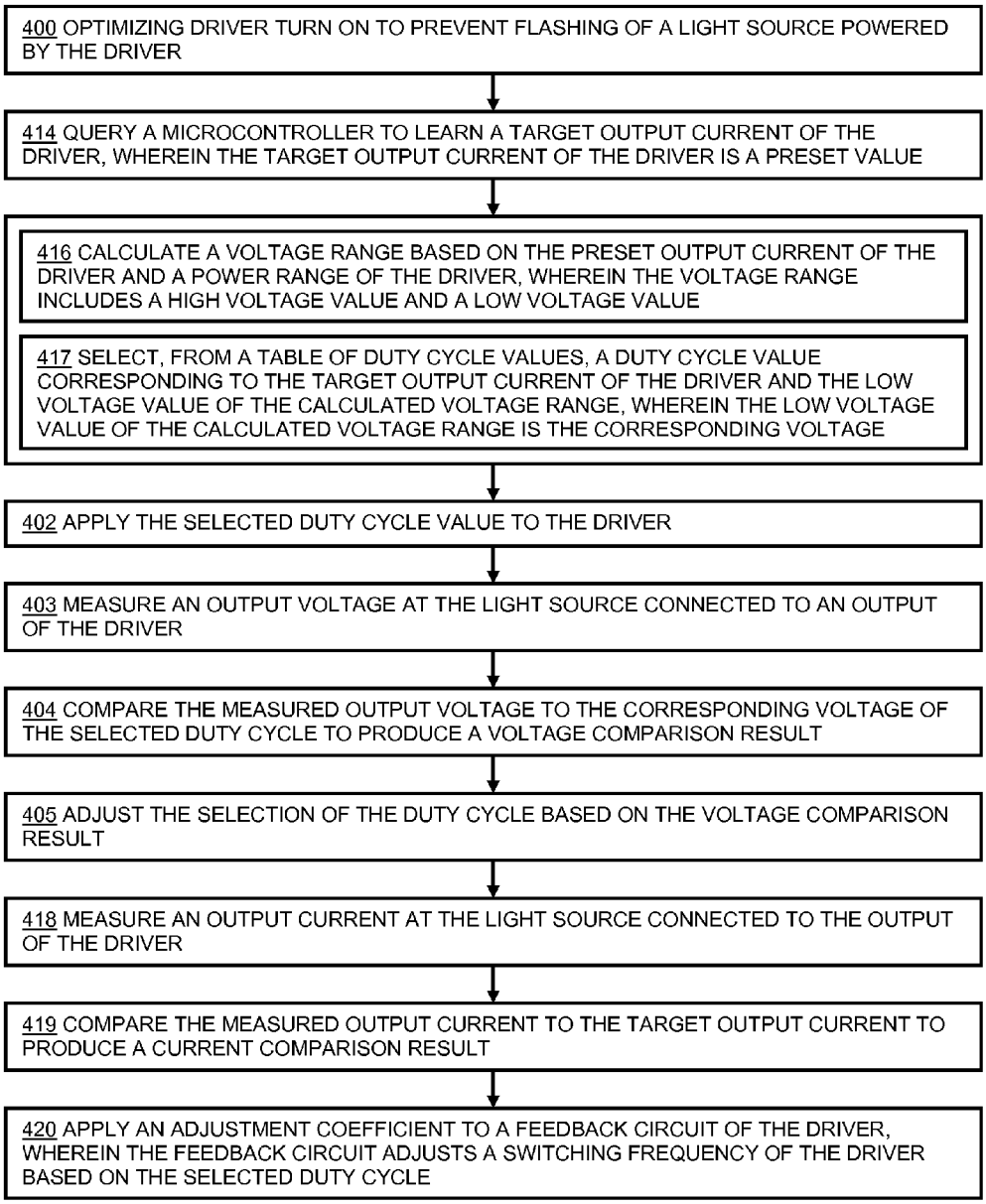
Figure 10A:
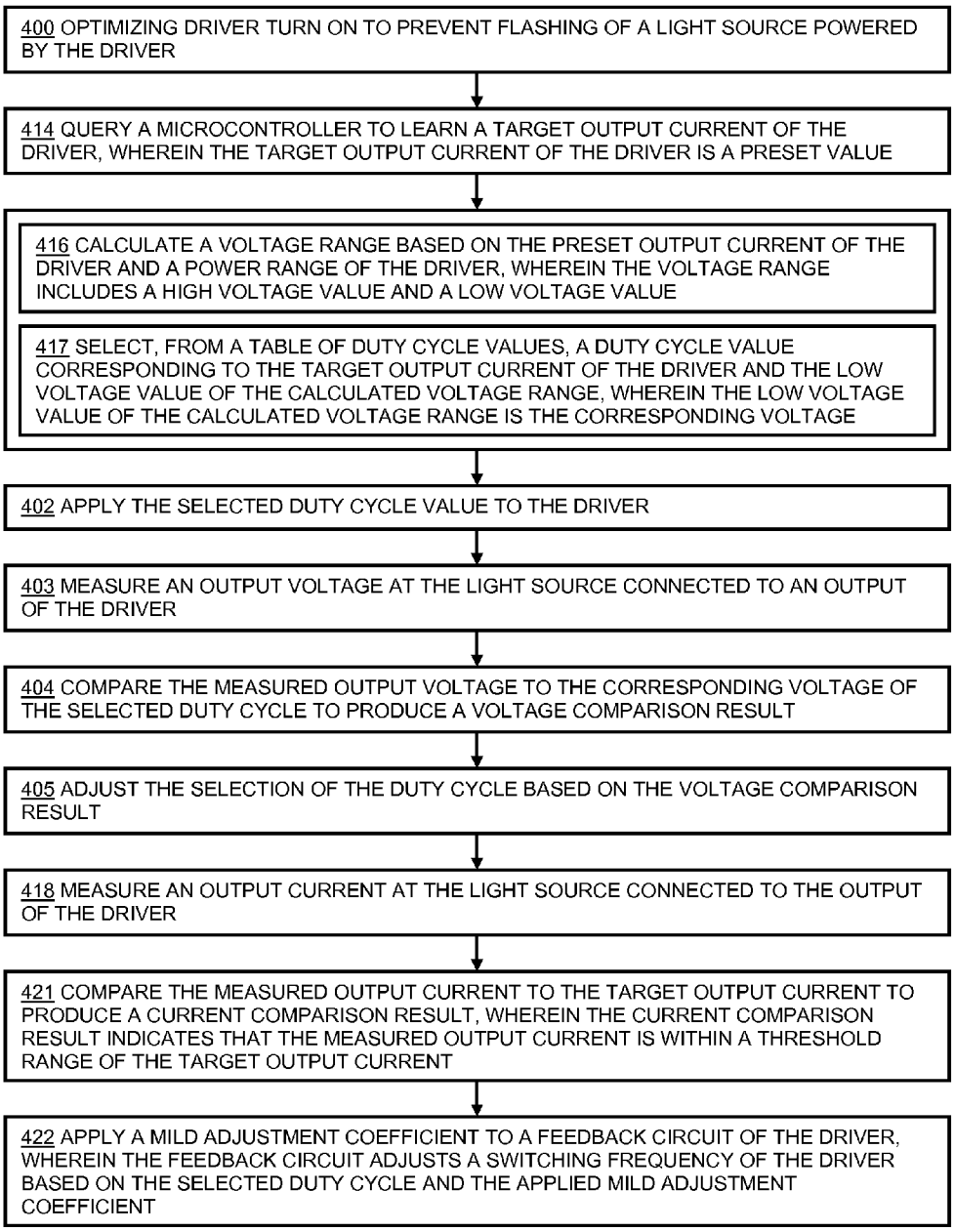
Figure 10B:
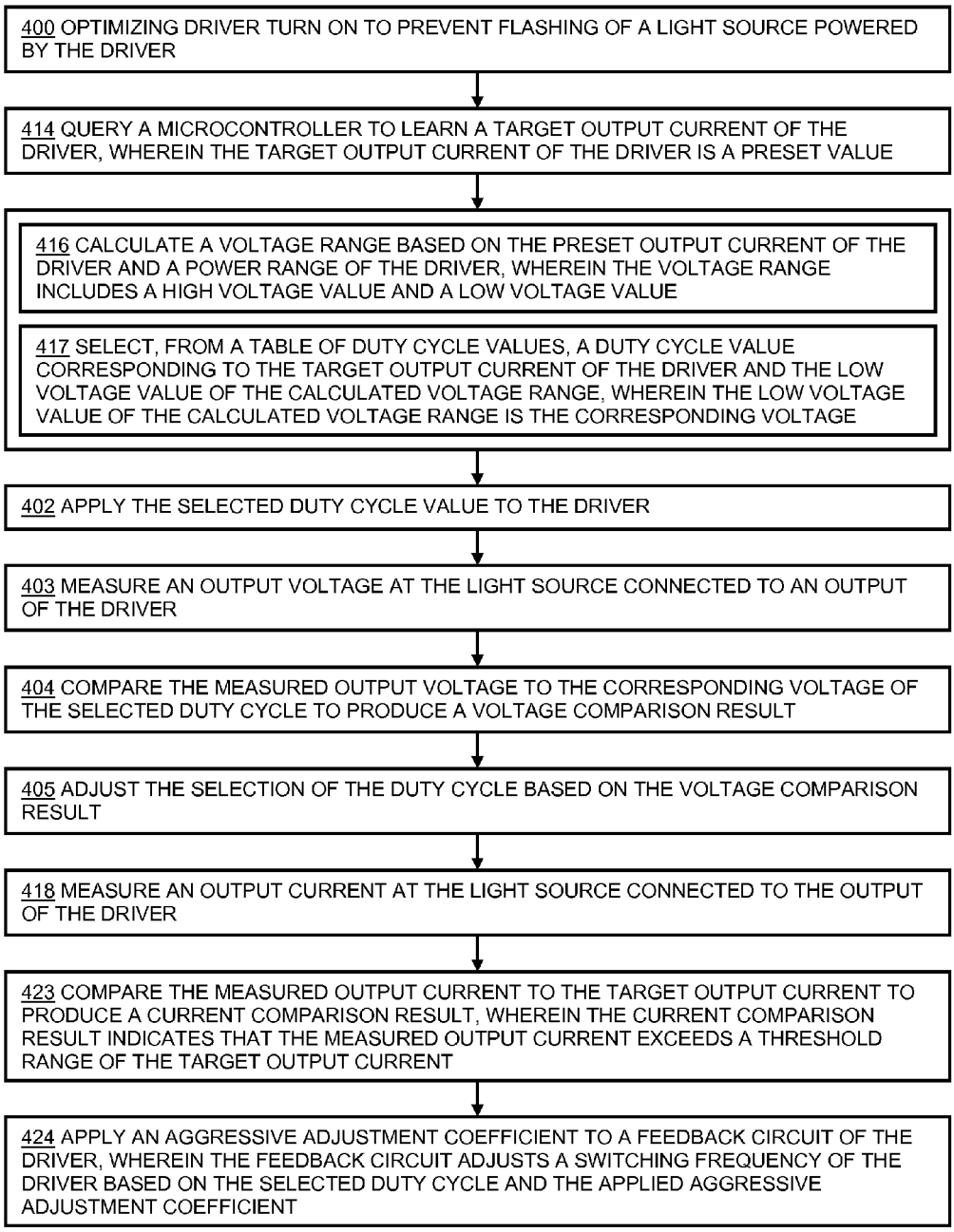

FIG. 9 shows the method 400 where the turn on optimization process 240-2 applies an adjustment coefficient in cases of the driver 101 being set to dim the light source 108. Thus, in FIG. 9, the turn on optimization process 240-2 measures the output current $I_{out}$ at the light source 108 connected to the output 107 of the driver 101, step 418, compares the measured output current $I_{out}$ to the target output current 260 to produce a current comparison result, step 419, and applies an adjustment coefficient to the feedback circuit 112 of the driver 101, wherein the feedback circuit 112 adjusts the switching frequency $f_{sw}$ of the driver 101 based on the selected duty cycle $D_{select}$, similarly to as described above in regards to FIGS. 5A and 5B. FIG. 10A shows the method 400 where the turn on optimization process 240-2 compares the measured output current $I_{out}$ to the target output current 260 to produce a current comparison result, wherein the current comparison result indicates that the measured output current $I_{out}$ is within a threshold range of the target output current 260, step 421, and the turn on optimization process 240-2 applies a mild adjustment coefficient to the feedback circuit 112 of the driver 101, wherein the feedback circuit 112 adjusts the switching frequency $f_{sw}$ of the driver 101 based on the selected duty cycle $D_{select}$ and the applied mild adjustment coefficient, step 422, similar to FIG. 5A. FIG. 10B shows the method 400 where the turn on optimization process 240-2 compares the measured output current $I_{out}$ to the target output current 260 to produce a current comparison result, wherein the current comparison result indicates that the measured output current $I_{out}$ exceeds a threshold range of the target output current 260, step 423, and the turn on optimization process 240-2 applies an aggressive adjustment coefficient to the feedback circuit 112 of the driver 101, wherein the feedback circuit 112 adjusts the switching frequency $f_{sw}$ of the driver 101 based on the selected duty cycle $D_{select}$ and the applied aggressive adjustment coefficient, similar to FIG. 5B.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or an and/or the to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A method of optimizing driver turn on to prevent flashing of a light source powered by the driver, the method comprising:

selecting, from a table of duty cycle values, a highest duty cycle value corresponding to a target output current of the driver, wherein the selected duty cycle value has a corresponding voltage;

applying the selected duty cycle value to the driver;

measuring an output voltage at the light source connected to an output of the driver;

comparing the measured output voltage to the corresponding voltage of the selected duty cycle to produce a voltage comparison result; and adjusting the selection of the duty cycle based on the voltage comparison result.

2. The method of claim 1, further comprising:

measuring an output current at the light source connected to the output of the driver;

comparing the measured output current to the target output current to produce a current comparison result; and applying an adjustment coefficient to a feedback circuit of the driver, wherein the feedback circuit adjusts a switching frequency of the driver based on the selected duty cycle.

3. The method of claim 2, wherein comparing the measured output current comprises:

comparing the measured output current to the target output current to produce a current comparison result, wherein the current comparison result indicates that the measured output current is within a threshold range of the target output current;

and wherein applying comprises:

applying a mild adjustment coefficient to a feedback circuit of the driver, wherein the feedback circuit adjusts a switching frequency of the driver based on the selected duty cycle and the applied mild adjustment coefficient.

4. The method of claim 2, wherein comparing the measured output current comprises:

comparing the measured output current to the target output current to produce a current comparison result, wherein the current comparison result indicates that the measured output current exceeds a threshold range of the target output current;

and wherein applying comprises:

applying an aggressive adjustment coefficient to a feedback circuit of the driver, wherein the feedback circuit adjusts a switching frequency of the driver based on the selected duty cycle and the applied aggressive adjustment coefficient.

5. The method of claim 1, further comprising repeating measuring, comparing, and adjusting until a most recent voltage comparison result indicates that a desired voltage comparison result is reached.

6. The method of claim 1, further comprising:

prior to selecting, querying a microcontroller to learn a target output current of the driver, wherein the target output current of the driver is a preset value.

7. The method of claim 1, further comprising:

prior to selecting, querying a microcontroller to learn a target output current of the driver, if the driver is to dim the light source, and a preset output current of the driver;

and wherein selecting comprises:

calculating a voltage range based on the preset output current of the driver and a power range of the driver, wherein the voltage range includes a high voltage value and a low voltage value; and selecting, from a table of duty cycle values, a duty cycle value corresponding to the target output current of the driver and the low voltage value of the calculated voltage range, wherein the low voltage value of the calculated voltage range is the corresponding voltage.

8. The method of claim 7, further comprising:

measuring an output current at the light source connected to the output of the driver;

comparing the measured output current to the target output current to produce a current comparison result; and applying an adjustment coefficient to a feedback circuit of the driver, wherein the feedback circuit adjusts a switching frequency of the driver based on the selected duty cycle.

9. The method of claim 8, wherein comparing the measured output current comprises:

comparing the measured output current to the target output current to produce a current comparison result, wherein the current comparison result indicates that the measured output current is within a threshold range of the target output current;

and wherein applying comprises:

applying a mild adjustment coefficient to a feedback circuit of the driver, wherein the feedback circuit adjusts a switching frequency of the driver based on the selected duty cycle and the applied mild adjustment coefficient.

10. The method of claim 8, wherein comparing the measured output current comprises:

comparing the measured output current to the target output current to produce a current comparison result, wherein the current comparison result indicates that the measured output current exceeds a threshold range of the target output current;

and wherein applying comprises:

applying an aggressive adjustment coefficient to a feedback circuit of the driver, wherein the feedback circuit adjusts a switching frequency of the driver based on the selected duty cycle and the applied aggressive adjustment coefficient.

11. A computer program product, stored on a non-transitory computer readable medium, including instructions that, when executed on a processor in communication with a driver to power a light source, cause the processor to perform operations of:

selecting, from a table of duty cycle values, a highest duty cycle value corresponding to a target output current of the driver, wherein the selected duty cycle value has a corresponding voltage;

applying the selected duty cycle value to the driver;

measuring an output voltage at the light source connected to an output of the driver;

comparing the measured output voltage to the corresponding voltage of the selected duty cycle to produce a voltage comparison result; and adjusting the selection of the duty cycle based on the voltage comparison result.

12. The computer program product of claim 11, wherein the instructions cause the processor to perform further operations of:

measuring an output current at the light source connected to the output of the driver;

comparing the measured output current to the target output current to produce a current comparison result; and applying an adjustment coefficient to a feedback circuit of the driver, wherein the feedback circuit adjusts a switching frequency of the driver based on the selected duty cycle.

13. The method of claim 11, wherein the instructions cause the processor to perform further operations of repeating measuring, comparing, and adjusting until a most recent voltage comparison result indicates that a desired voltage comparison result is reached.

14. The method of claim 11, wherein the instructions cause the processor to perform further operations of:

prior to selecting, querying a microcontroller to learn a target output current of the driver, wherein the target output current of the driver is a preset value.

15. The method of claim 11, wherein the instructions cause the processor to perform further operations of:

prior to selecting, querying a microcontroller to learn a target output current of the driver, if the driver is to dim the light source, and a preset output current of the driver;

and wherein the processor performs operations of selecting by:

calculating a voltage range based on the preset output current of the driver and a power range of the driver, wherein the voltage range includes a high voltage value and a low voltage value; and selecting, from a table of duty cycle values, a duty cycle value corresponding to the target output current of the driver and the low voltage value of the calculated voltage range, wherein the low voltage value of the calculated voltage range is the corresponding voltage.

16. A system to prevent flashing of a light source, comprising:

a driver to power the light source; and a computer system, wherein the computer system comprises:

a processor;

a memory;

an input interface and an output interface, each in communication with the driver; and an interconnection mechanism allowing communication between the processor, the memory, the input interface, and the output interface;

wherein the memory includes a turn on optimization application that, when executed in the processor as a turn on optimization process, causes the computer system to perform operations of:

selecting, from a table of duty cycle values stored in the memory, a highest duty cycle value corresponding to a target output current of the driver, wherein the selected duty cycle value has a corresponding voltage;

applying, via the output interface, the selected duty cycle value to the driver;

measuring, via the input interface, an output voltage at the light source connected to an output of the driver;

comparing the measured output voltage to the corresponding voltage of the selected duty cycle to produce a voltage comparison result; and adjusting the selection of the duty cycle based on the voltage comparison result.

17. The system of claim 16, wherein the driver includes a feedback circuit, and wherein the computer system performs further operations of:

measuring, via the input interface, an output current at the light source connected to the output of the driver;

comparing the measured output current to the target output current to produce a current comparison result; and applying, via the output interface, an adjustment coefficient to the feedback circuit of the driver, wherein the feedback circuit adjusts a switching frequency of the driver based on the selected duty cycle.

18. The system of claim 16, wherein the computer system performs further operations of repeating measuring, comparing, and adjusting until a most recent voltage comparison result indicates that a desired voltage comparison result is reached.

19. The system of claim 16, wherein the computer system performs further operations of:

prior to selecting, querying the memory to learn a target output current of the driver, wherein the target output current of the driver is a preset value.

20. The system of claim 16, wherein the computer system performs further operations of:

prior to selecting, querying the memory to learn a target output current of the driver, if the driver is to dim the light source, and a preset output current of the driver;

and wherein when selecting, the computer system performs operations of:

calculating a voltage range based on the preset output current of the driver and a power range of the driver, wherein the voltage range includes a high voltage value and a low voltage value; and selecting, from a table of duty cycle values stored in the memory, a duty cycle value corresponding to the target output current of the driver and the low voltage value of the calculated voltage range, wherein the low voltage value of the calculated voltage range is the corresponding voltage.

* * * * *